United States Patent [19]

Schwager et al.

[11] Patent Number: 4,582,074

[45] Date of Patent: Apr. 15, 1986

[54] HAIR TWINING APPARATUS

[75] Inventors: Frederic A. Schwager, Manhattan Beach; Mark S. Wittenberg, Anaheim, both of Calif.

[73] Assignee: Mattel, Inc., Hawthorne, Calif.

[21] Appl. No.: 475,007

[22] Filed: Mar. 14, 1983

[51] Int. Cl.[4] ..... A45D 1/00

[52] U.S. Cl. ..... 132/9

[58] Field of Search ..... 132/9; 87/33

[56] References Cited

U.S. PATENT DOCUMENTS

| | | | |
|---|---|---|---|
| Re. 15,909 | 9/1924 | Pfrunder . | |
| 352,804 | 11/1886 | Bowersox . | |
| 359,409 | 3/1887 | Stone . | |
| 433,855 | 8/1890 | Ellis . | |
| 830,137 | 9/1906 | Diss . | |
| 1,398,444 | 11/1921 | Pfrunder . | |
| 1,900,310 | 3/1933 | Somerville . | |
| 2,254,895 | 9/1941 | Johnston, Jr. . | |
| 2,782,590 | 2/1957 | Lowe | 57/58.52 |
| 2,878,514 | 3/1959 | Nichols et al. | 18/19 |
| 3,360,915 | 1/1968 | Franzen | 57/58.49 |
| 3,421,406 | 1/1969 | Mitchell et al. | 87/30 |
| 3,439,486 | 4/1969 | Klein | 57/58.49 |
| 3,552,693 | 1/1971 | Scherf | 242/131 |
| 3,834,146 | 9/1974 | Nessler et al. | 57/58.54 |
| 4,038,996 | 8/1977 | Eronini et al. | 132/9 |
| 4,262,479 | 4/1981 | Lenorak | 57/58.54 |
| 4,307,737 | 12/1981 | Shipman | 132/9 |
| 4,369,690 | 1/1983 | Sapkus | 87/33 |

*Primary Examiner*—Gregory E. McNeill

*Attorney, Agent, or Firm*—Ronald M. Goldman; Melvin A. Klein; Daniel F. Sullivan

[57] ABSTRACT

A hair twining apparatus configured for one hand operation of a trigger, the apparatus having at least two hair clamp members carried by a sub-housing within a housing. With a switch in a first position, pumping of the trigger rotates the clamp members about the supporting shafts thereof for twisting groups of hair filaments attached to the clamp members. With the switch in a second position, pumping of the trigger causes intermittent unidirectional angular displacement of the hair clamp members to twine the strands by rotating the sub-housing.

9 Claims, 7 Drawing Figures

HAIR TWINING APPARATUS

DESCRIPTION

Technical Field

This invention relates to hair twining apparatus, and more particularly to hand operated hair twining apparatus for use with human or synthetic hair.

CROSS-REFERENCE TO RELATED APPLICATION

The subject matter of this application is related to the subject matter of U.S. patent application Ser. No. 367,483, filed Apr. 12, 1982 by Jurgis Sapkus for "Hair Braiding Apparatus", assigned to Mattel, Inc., the assignee of the instant application.

BACKGROUND ART

Braiding machines have been used extensively in the textile industry. Such braiding machines are shown and described, for example, in U.S. Pat. Nos. 352,804, issued Nov. 16, 1886 to Bowerson; 433,855, issued Aug. 5, 1890 to Ellis; 830,137, issued Sept. 4, 1906 to Diss; 1,398,444, issued Nov. 29, 1921 to Pfrunder; Re. 15,909, issued Sept. 2, 1924 to Pfrunder; 1,900,310, issued Mar. 7, 1933 to Somerville; 2,254,895, issued Sept. 2, 1941 to Johnston, Jr.; 2,782,590, issued Feb. 26, 1957 to Lowe; 2,878,514, issued Mar. 24, 1959 to Nichols et al; 3,360,915, issued Jan. 2, 1968 to Franzen; 3,421,406, issued Jan. 14, 1969 to Mitchell et al; 3,439,486, issued Apr. 22, 1969 to Klein; 3,552,693, issued Jan. 5, 1971 to Scherf; 3,834,146, issued Sept. 10, 1974 to Nessler, et al; and 4,262,479, issued Apr. 21, 1981 to Lenorak. Another similar type of device intended for use with wire is shown and described in U.S. Pat. No. 359,409, issued Mar. 15, 1887 to Stone.

Such prior art braiding machines for use in creating yarn, for example, are simply twisting machines. Other such devices for use in forming rope or cord ordinarily employ means for simply interweaving two strands. Other such devices for use in the textile industry tend to be complicated apparatus, part of an overall machine, with complex mechanisms.

A braiding machine intended specifically for hair is shown and described in U.S. Pat. No. 4,038,996, issued Aug. 2, 1977, to Eronini, et al. The hair braider apparatus of that patent is a portable hair braider which is motor operated, and uses a plurality of foot members for hair parters to divide the hair over a predetermined width of the scalp, with hair grabbers then clamping the hair thusparted and rotating the strands for weaving them together to form a braid.

Another braiding machine intended for use with hair is shown and described in U.S. Pat. No. 4,307,737, issued Dec. 29, 1981 to Shipman. In the apparatus of this patent, three strands of hair are drawn through three elongated tubes mounted for movement within an elongated cylindrical housing, having an operating lever extending out through a slot in the surface thereof. The tubes are intermittently alternated by the operator, a pair at a time, by means of guide members positioned within a central opening. The three tubes are movable along a track passing through the guide members for alternately selecting a pair of tubes for rotation.

Other braiding apparatus intended for use with hair is shown and described in U.S. Pat. No. 4,369,690, issued Jan. 25, 1983 to Sapkus, and assigned to Mattel, Inc., the assignee of the instant invention. The apparatus disclosed is a hand held, hand operated device having a plurality of aligned gear members, each having an aperture therethrough for passage therethrough of a plurality of hair filaments with a first pair of adjacent gear members having the positions interchanged in response to actuation of a lever member in a first direction with the remaining gear member then being interchanged with the adjacent one in response to pivoting of the lever member in the reverse direction.

DISCLOSURE OF INVENTION

The present invention is an improvement of the above-mentioned U.S. patent application Ser. No. 367,483, and employs a unique, compact gear mechanism to facilitate one hand operation. In the apparatus of the subject application, a housing is provided intermediate the operator's handle and the hair-clamping members with the housing being restrained by one hand of the operator while actuating the lever with the other hand to twist the strands of hair. In the instant invention, a ratchet and gear mechanism is assembled within the housing and selectively controlled by a switch actuable by the thumb of the same hand of the operator.

The invention includes first and second clamp members coupled to shafts having orbital gears at the ends thereof, the orbital gears being assembled for selective rotation by a main drive gear, these three gears being mounted in a subhousing member. Lateral movement of the switch provides axial displacement of a carrier member to a first position enabling rotation of the shafts and clamp members to twist a plurality of hair filaments into individual strands of hair, and to a second position enabling the interchanging of the positions of the shafts and clamp members through an angle of 180° to intertwine the strands.

It is an object of the invention to provide a new and improved manually operable hair twining or braiding apparatus.

It is another object of the invention to provide a new and improved hair braiding apparatus configured for operation with one hand to twist individual filaments of hair into strands and then intertwine the strands, the mechanism employing a novel gear and ratchet assembly.

The objects, features and advantages of the invention will be better understood with reference to the following description, when taken in conjunction with the drawings in which like reference numerals refer to like elements in the several views.

BEST MODE FOR CARRYING OUT THE INVENTION

Figure 1:
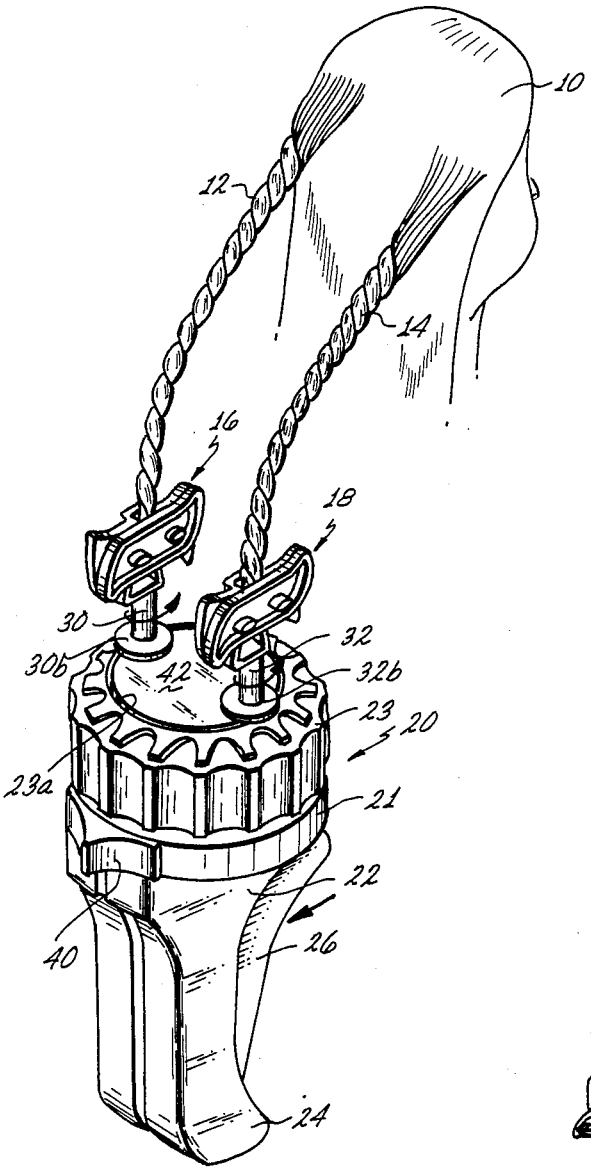
FIG. 1 is a perspective view of the hair twining or braiding apparatus of the invention illustrating the operation thereof while twisting hair filaments into strands.
Figure 2:
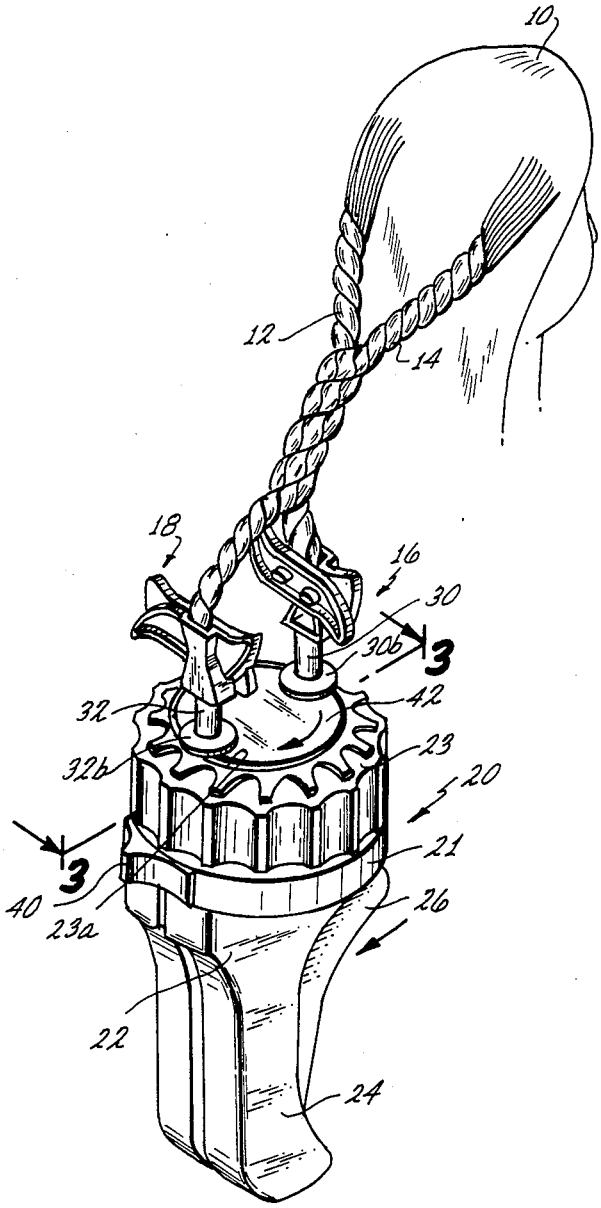
FIG. 2 is a perspective view similar to FIG. 1 depicting the operation of the apparatus intertwining the strands.

Referring now to the drawings, and particularly to FIGS. 1 and 2, there is shown a head 10 of a human or doll, with first and second strands 12 and 14 of hair received within first and second clamp members 16 and 18, respectively, of the hair braiding apparatus, generally designated by the reference numeral 20.

The hair braiding apparatus 20 is configured for being hand held and hand operated, with the apparatus including a main housing 22 having a handle portion 24, pivotally receiving therein an actuating member, or trigger 26 positioned for actuation by the hand of an operator against the force of a spring 28 (see also FIG. 3) abutting against the interior of the handle portion 24 while urging against the trigger 26.

Prior to a detailed description of the hair braiding apparatus 20, a description of the operation will be provided with reference to FIGS. 1 and 2. Structurally, the hair clamp members 16 and 18 are each formed as unitary plastic members having an integral hinge portion and snap lock means similar to conventional low cost barettes. The clamp members 16 and 18 are secured to the upper ends of first and second generally parallel shaft projections 30 and 32 which are coupled to orbital gear members 34 and 36, respectively, (see FIG. 3) received within housing 22. As will be described later in detail, the clamp members 16 and 18, along with shaft projections 30 and 32 are adapted for rotation relative to each other and relative to the housing 22. To effect the different rotations utilized, a switch 40 is positioned above the rear surface of the handle portion 24 of the housing 22 for ready actuation with the thumb of the hand of the operator, the switch being movable left to right as viewed in FIGS. 1 and 2, to a first or second position.

With the switch 40 in a first position to the right in FIG. 1, and with a plurality of filaments of hair received and retained in each of the clamp members 16 and 18, pumping or repeated depression of the trigger 26 rotates both shaft projections 30 and 32 simultaneously in counterclockwise directions, as indicated by the arrows thereabout, to form strands 12, 14. During this operation, the shaft projections remain in fixed alignment relative to the housing 22, and the strands 12 and 14 of hair are twisted without braiding or intertwining.

When the switch 40 is moved to the left as illustrated in FIG. 2, and the trigger 26 is repeatedly pumped or actuated, the shaft projections 30 and 32 have the physical positions thereof relative to the housing continually displaced in a clockwise direction as indicated by the arrow on the disc member 42 which rotates during this operation carrying with it the shaft projections 30 and 32.

Briefly, in use, the operator affixes a plurality of filaments of hair to each of the clamp members 16 and 18, and with the switch 40 in the rightmost position of FIG. 1, actuates the trigger 26 until the desired twist of each strand 12, 14 is achieved, and then with the thumb the operator moves the switch 40 to the opposite position, repeats the actuation of the trigger 26 until the desired braid or twine is achieved, at which point the clamp members 16 and 18 are released and a barette or ribbon is applied to secure the twine.

Figure 3:
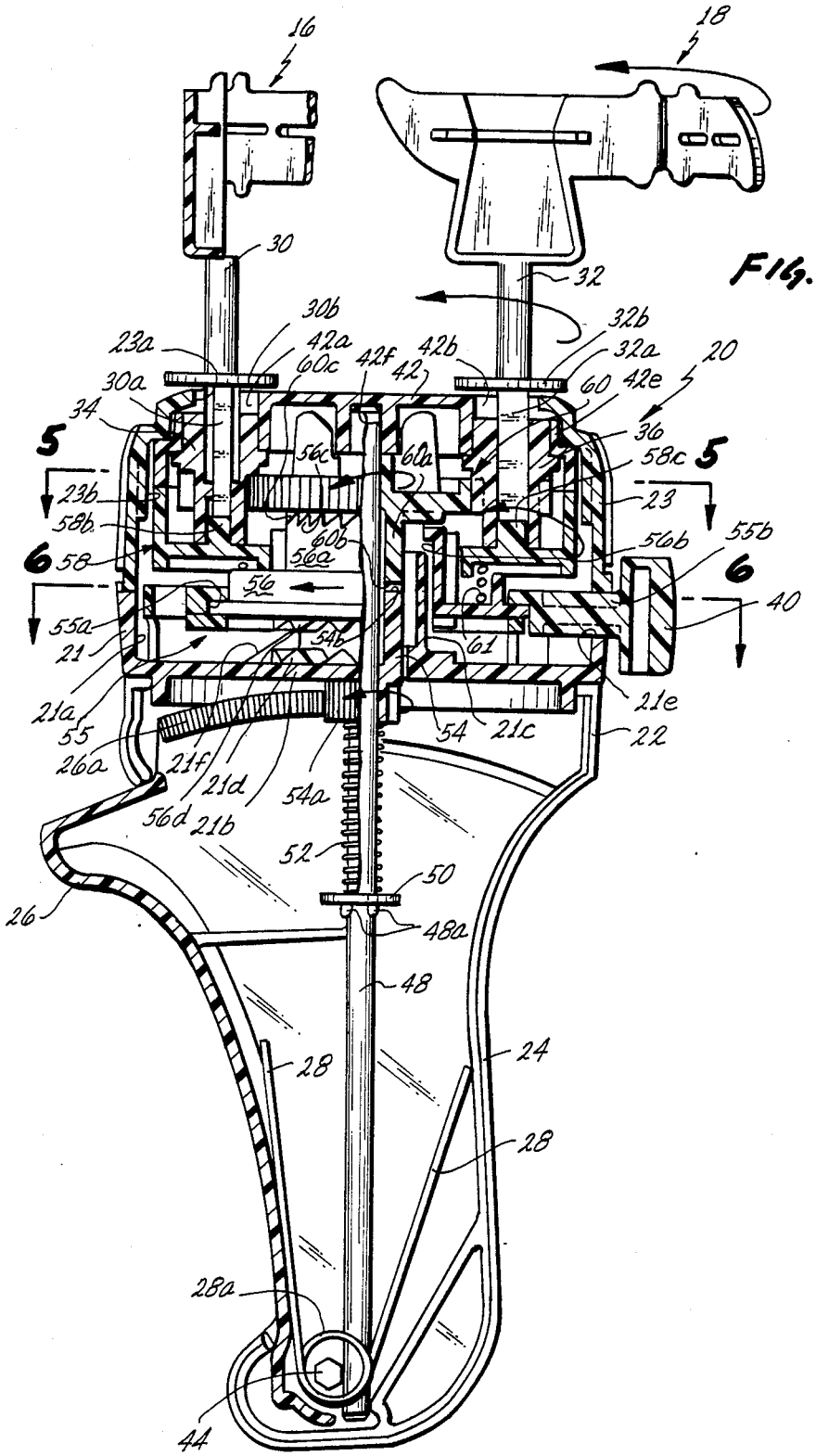
FIG. 3 is a plan view of the hair braiding or twining apparatus of FIG. 2, partially in cross-section, and partially broken away, as viewed generally along line 3—3 thereof.
Figure 7:
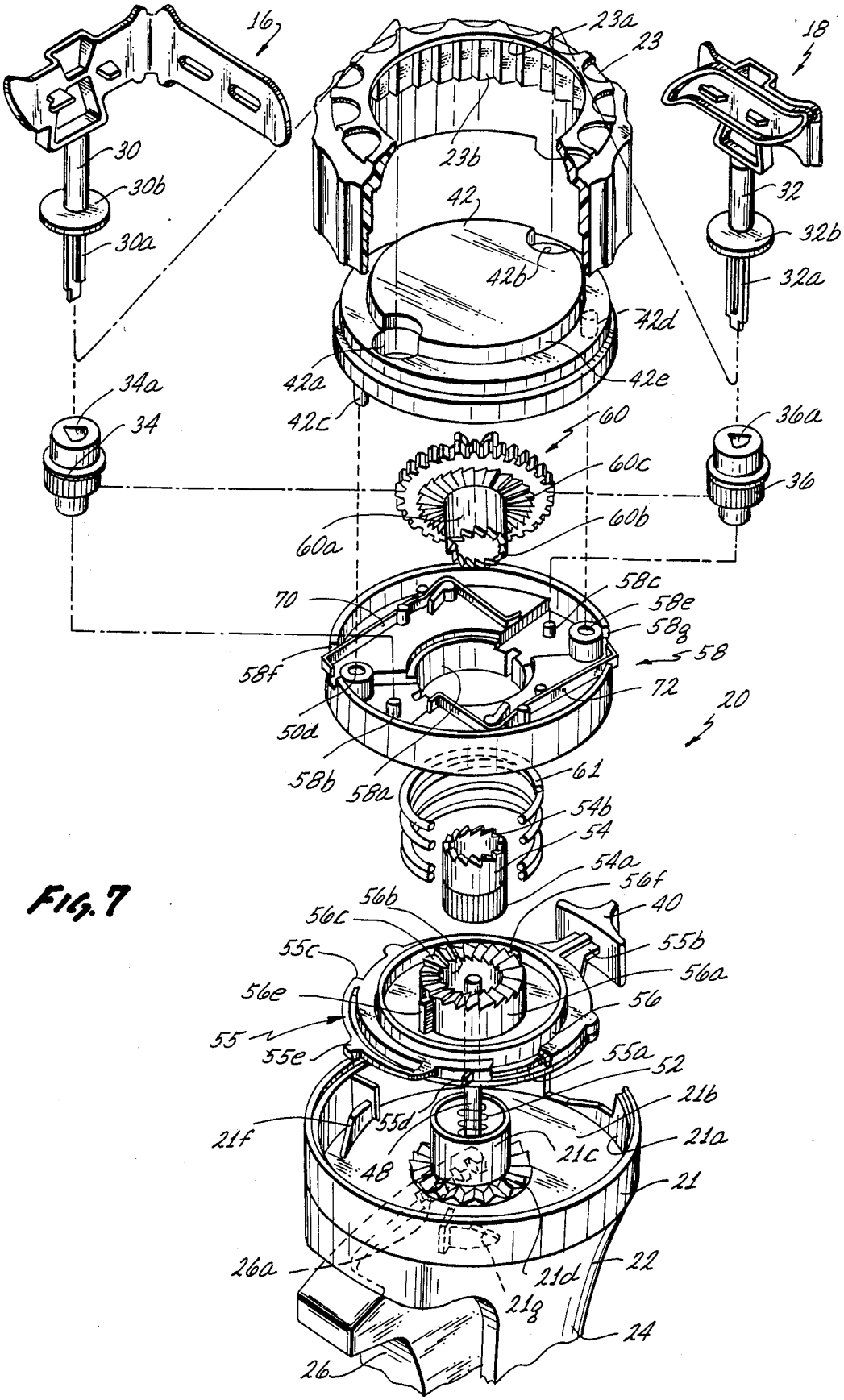
FIG. 7 is an exploded perspective view of the mechanism of the apparatus of FIG. 1, partially in cross-section and partially broken away, with the drive gear member thereof partially rotated to illustrate details thereof.

Referring now to FIGS. 3 and 7, and particularly to FIGS. 3 and 7, the details pertaining to the construction of the apparatus 20 will be described. The housing 20 includes the hollow handle portion 24, an intermediate housing portion 21, and an upper housing portion 23. Although not clearly shown, as is common in plastic assembly, the handle portion 24 would ordinarily be formed of two parts which would then be secured together to form the hollow handle portion 24.

As illustrated in FIG. 3, the trigger 26 is mounted within the handle portion 24 for pivoting about the pivot 44 which is also encircled by the coil portion 28*a* of the spring member 28, which has one leg thereof abutting against the interior of the trigger 26 and the other leg thereof urging against the interior of handle portion 24. The upper end of trigger 26 has integrally formed therewith an arcuate rack member 26*a*. The upper end of the handle portion 24 is generally closed by the intermediate housing portion 21, which is generally cup-shaped with a circular peripheral wall surface 21*a* and a bottom disc surface 21*b*. Extending upwardly from the disc surface 21*b* is a generally centrally disposed cylindrical sleeve portion 21*c* with a serrated or toothed surface 21*d* formed in the disc surface 21*b* about the bottom of the sleeve portion 21*c*.

Mounted within the housing 22 is a shaft 48 which has one end thereof resting in the bottom of the handle portion 24, the shaft 48 extending through the sleeve portion 21*c* and being held captive at the other end thereof within a recess 42*f* formed in the undersurface of the disc surface 42, the shaft 48 essentially being the axis of rotation of several of the parts to be hereafter described. As shown in FIG. 3, the shaft 48 is crimped at 48*a* to form a shoulder within the handle portion 24 with a washer 50 assembled on the shaft 48 for limiting movement of one end of a coil spring 52 encircling the shaft 48. Assembled on the shaft 48 thereafter is a pinion gear member 54, freely rotatable thereon with the lower surface of the pinion gear member 54 urging against the upper end of the coil spring 52. The pinion gear member 54 has a pinion gear portion 54*a* formed about the lower periphery thereof and a ratchet portion 54*b* formed in the upper edge thereof, the member 54 being dimensioned for insertion within the sleeve portion 21*c* of the intermediate housing portion 21 and rotatable therein.

The rack portion 26*a* of trigger 26 engages the pinion portion 54*a* of the pinion gear member 54, resulting in oscillatory motion of member 54 during repeated pumping of the trigger 26. Positionable within the intermediate housing portion 21 is a carrier member 55, pivotable through a limited angle by means of the switch 40, the carrier member 55 being generally annular with a track 55*a* for rotatably supporting a coupling member 56 therein. The carrier member 55 has three equiangular projections 55*b*, 55*c* and 55*d* for coacting with equiangularly disposed cams or ramps 21*e*, 21*f* and 21*g* formed within the intermediate housing 21. Pivoting of the carrier member 55 then raises or lowers the member 55 along with the coupling member 56. The projection 55*b* has the switch 40 secured thereto in a manner accessible to the operator. The carrier member 55, in addition, is provided with a spring detent 55*e* for coacting with a protrusion 21*h* (see FIG. 6) for locking the carrier 55 to the left or right and for inhibiting rotation of the carrier 55 during rotation of coupling member 56.

The coupling member 56 has a generally disc-shaped base portion with a centrally disposed integrally formed tubular portion 56*a* having a central aperture 56*b* extending therethrough, the upper edge of portion 56*a* having ratchet teeth 56*c* formed therein in an axial direction. The diameter of aperture 56*b* is greater than the diameter of sleeve portion 21*c* of the intermediate housing portion 21 for passage therein on a non-interference basis. The lower surface of coupling member 56 is provided with a toothed annulus 56*d* (see FIG. 3).

Figure 4:
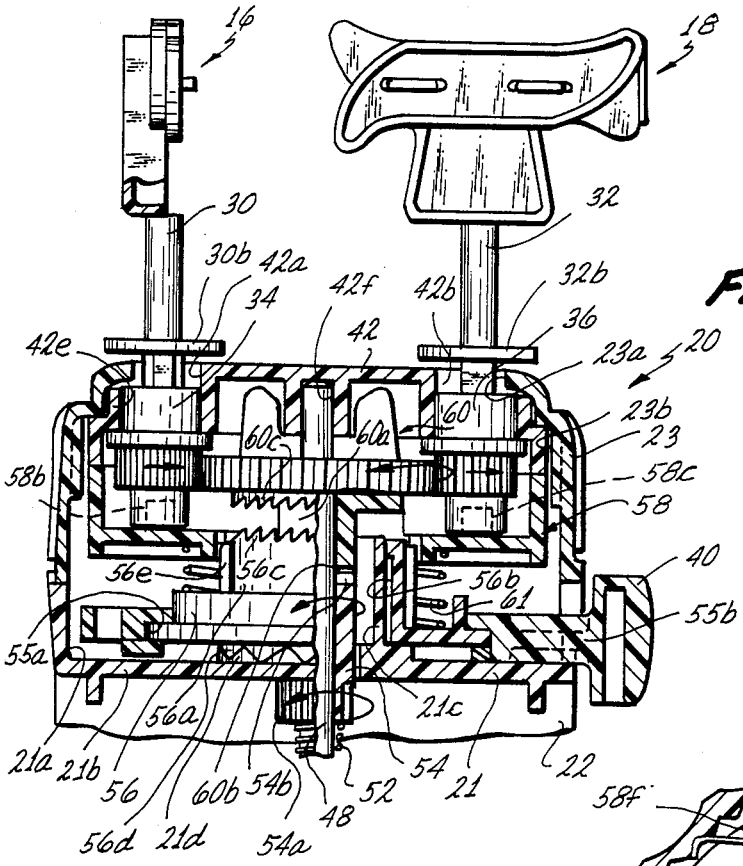
FIG. 4 is a partial plan view of the upper portion of the mechanism illustrated in FIG. 3, with the operative parts thereof shown in the alternate position.

Referring to FIGS. 3, 4 and 7, the coupling member 56 is configured to couple a sub-housing 58, which has secured thereto the disc member 42, for concurrent rotation in one direction only, or for maintaining the sub-housing 58 along with disc member 42 stationary, these two operations corresponding to the two modes of use of the apparatus 20 previously described. For this purpose the tubular portion 56*a* is provided with diametrically opposed splines or lugs 56*e* and 56*f* for engaging a matingly configured aperture 58*a* formed in sub-housing 58. With the two parts thus splined together, they either rotate together, or remain stationary together.

To provide selective movement, by reference to FIGS. 3 and 4, the carrier member 55 along with coupling member 56 are shown in the raised and lowered positions respectively. In FIG. 3, it can be seen that the toothed annulus 56*d* lies directly above the toothed annulus 21*d* of the intermediate housing 21, and in FIG. 4, the two are in engagement. Correspondingly, the unidirectional ratchet mechanism consisting of the ratchet teeth 56*c* is in engagement with the ratchet teeth 60*c* of drive gear member 60 (to be described) in FIG. 3 and out of engagement in FIG. 4. Encircling the tubular portion 56*a* of the coupling member 56 and interposed between the disc portion thereof and the sub-housing 58 is a compression coil spring 61 which serves as a clutch spring for the unidirectional clutch mechanism.

In the upper surface of the sub-housing 58, integrally formed upwardly extending diametrically opposed stub shafts 58*b* and 58*c* rotatably receive thereon the orbital gear members 34 and 36 which have pinion gear surfaces about the mid-portions thereof (see FIGS. 3 and 7) for coacting with the teeth of the main drive gear member 60. Orbital gear members 34 and 36 are provided with triangular apertures at the upper ends for receiving therein matingly configured ends 30*a* and 32*a* of the shaft projections 30 and 32, respectively.

In FIG. 7, the main drive gear member 60 has been slightly rotated to illustrate the configuration of the underside thereof with a downwardly depending central sleeve portion 60*a* having the lower edge 60*b* thereof in the form of a ratchet edge. Formed in the lower surface of the member 60 is a second ratchet surface 60*c* of a larger diameter equal to the diameter of the ratchet edge or surface 56*c* of the coupling member 56 with which it coacts. Similarly, the diameter of the ratchet edge 60*b* is equal to the diameter of the ratchet edge 54*b* of the pinion gear member 54 with which it coacts. The disc member 42 is provided with diametrically opposed aligned openings 42*a* and 42*b* through which pass the shaft projections 30 and 32, respectively, the shaft projections 30 and 32 having secured thereto washer members 30*b* and 32*b*, respectively, for providing lateral stability. The disc member 42 has depending projections 42*c* and 42*d* for being received within sleeves 58*d* and 58*e*, respectively, of subhousing 58. Consequently, the disc member 42 will rotate concurrently with the sub-housing 58 and may be considered a part thereof.

Figure 5:
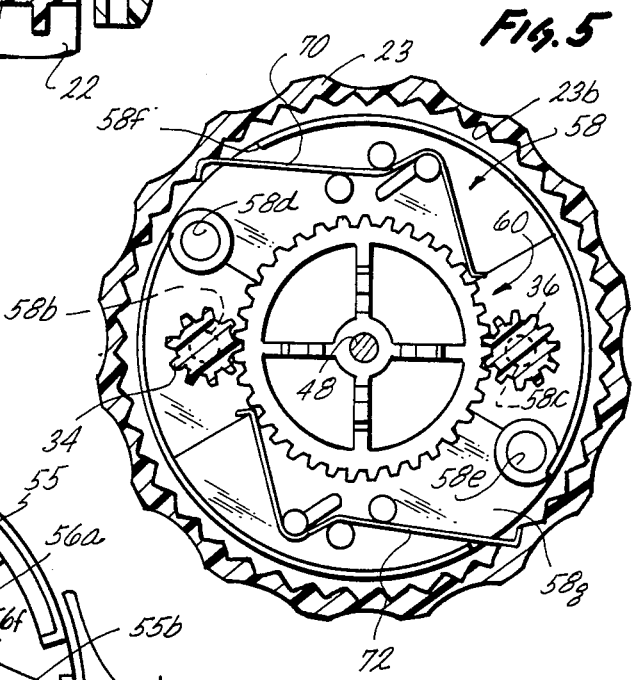
FIG. 5 is a cross-sectional view of the apparatus of FIG. 3 as viewed generally along lines 5—5 thereof.

By reference to FIGS. 5 and 7, the upper housing portion 23 is of an inverted generally cup-shaped configuration with an enlarged central aperture 23*a* of a diameter slightly larger than the diameter of the circular shoulder 42*e* of the domed center portion of disc member 42. The inner portion 23*b* of the wall of the upper housing portion 23 is toothed or serrated, for coacting with bent ends of leaf springs 70 and 72 assembled on the upper surface of the sub-housing 58, the bent ends extending beyond the periphery of the sub-housing 58 by virtue of the cut-outs 58*f* and 58*g*.

Having described the parts, the assembly of the apparatus will now be described with reference to FIG. 7 particularly, and also with reference to FIGS. 3 and 5. Initially, the trigger 26 is assembled within handle portion 24 and the spring 28 is attached as shown in FIG. 3. The washer 50 is positioned on the shaft 48, followed by the coil spring 52 and then the intermediate housing portion 21 is secured to the handle portion 24 of the housing 22 as shown in FIG. 7. The carrier member 55 is next assembled by positioning the aperture 56*d* for passage over the shaft 48 with the projection 56*a* extending through the cammed slot 21*e* of the intermediate housing portion 21 and the flanged portion 56*b* resting atop the cammed edge 21*f*. The pinion gear member 54 is then inserted over the shaft 48 passing through the aperture 56*d* until resting on the upper end of spring 52. The compression spring 61 is then placed on the coupling member 56 about the periphery of the tubular portion 56*c*.

The sub-housing 58 then has the left springs 70 and 72 suitably secured thereto with the bent ends thereof extending out through the cutouts 58*d* and 58*e*. Next, the orbital gear members 34 and 36 are positioned on bearings or stub shafts 58*b* and 58*c*. The drive gear member 60 is then positioned with the sleeve portion 60*a* thereof passing through the aperture 58*a* of the sub-housing 58. At this point, by reference to FIGS. 5 and 7, it can be seen that the inner free ends of leaf springs 70 and 72 are bent to detent within the teeth of the drive gear portion of the main drive gear 60. The disc member 42 is then suitably secured to the sub-housing 58 to close the same, and the sub-housing assembly is then placed atop the compression spring 61 with the splines or lugs 56*e* and 56*f* coactingly engaging the matingly configured portions of the aperture 58*a* of the sub-housing 58. As the sub-housing 58 is urged into engagement, the upper end of shaft 48 will engage the recess 42*a* formed centrally in the under surface of disc or cover member 42. The upper housing portion 23 is then positioned over this and the skirt portion thereof is suitably bonded to the peripheral wall 21*a* of the intermediate housing portion 21. The clamp members 16 and 18 are then secured to the upper ends of shaft projections 30 and 32, the washer members 30*b* and 32*b* are secured adjacent the mid-points of the shaft projections 30 and 32, respectively, and the lower ends 30*a* and 32*a* are then inserted into and secured within the apertures 34*a* and 36*a* of the orbital gear members 34 and 36, respectively.

Prior to a detailed discussion of the operation and interaction of the various parts, the configuration and interaction of certain parts will be emphasized to enable a better understanding of the operation. Initially, the configuration and interaction of the toothed surface 21*d* and the toothed surface 56*d* serves simply to inhibit rotation of the coupling member 56 when in its lower position. The interaction of the ratchet edge 56*c* of the coupler 56 with the ratchet edged surface 60*c* of drive gear 60 is intended to drive the drive gear 60 along with the sub-housing 58 in a clockwise direction (as viewed in FIG. 2) in the twining mode of operation.

The ratchet mechanism formed by the coacting ratchet edge 54*b* of the pinion gear member 54 with the ratchet edge 60*b* of the drive gear member 60 is intended to favor rotation in the clockwise direction, and the inclination of the ratchet teeth is so configured. The inwardly extending bent portions of the leaf spring members 70 and 72 coacting with the teeth of the drive gear 60 as well as the outwardly extending bent portions of the leaf springs 70 and 72 coacting with the inner wall 23*b* of the upper housing portion 23 are intended to provide needed friction during operation in one mode or the other. With this brief description of the ratchet means and the friction means, a detailed description of the operation will now commence.

Figure 6:
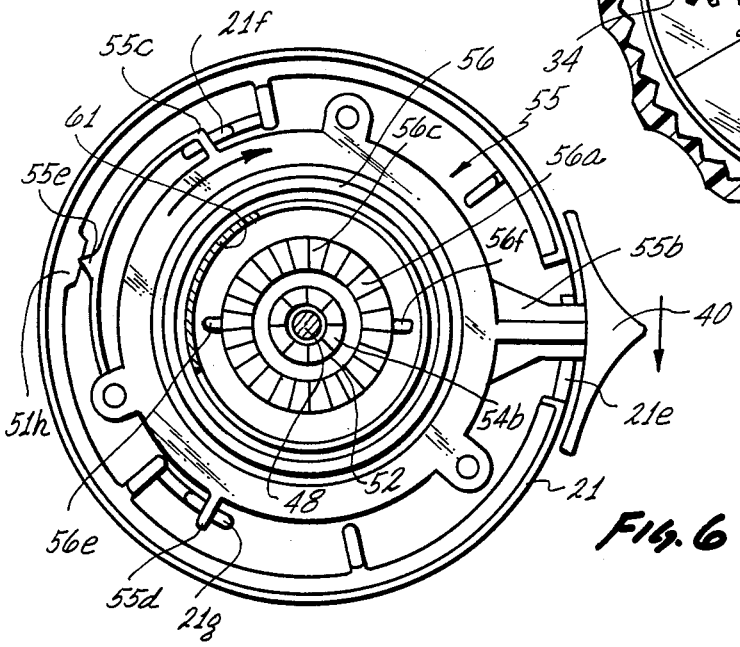
FIG. 6 is a cross-sectional view of the apparatus of FIG. 3, as viewed generally along line 6—6 thereof.

Initially, by reference to FIG. 4, the carrier member 55 is in its lowermost position corresponding to the switch 40 being to the right, as viewed in FIG. 1, or pivoted fully counterclockwise, as viewed in FIG. 6. Conversely, by reference to FIG. 3, the carrier member 55 is in its uppermost position corresponding to the switch 40 being in the left, as viewed in FIG. 2, or pivoted fully clockwise, as viewed in FIG. 6.

With reference to FIGS. 1, 4, 5, 6, and 7, the operation will be described in the first mode, that is with the strands 12 and 14 of hair coupled to the clamp members 16 and 18 for twisting. With the switch 40 to the right as shown in FIG. 1, as previously described, the shaft projections 30 and 32 will remain in the position illustrated, and pumping or actuation of the trigger 26 will cause the shaft projections 30 and 32 to rotate, each about its own axis, thus causing rotation of the clamp members 16 and 18, respectively, in a counterclockwise direction, as indicated by the arrows encircling the shaft projections 30 and 32. In this mode, the disc surface member 42 is fixed relative to the housing 22 of the apparatus 20.

With switch 40 to the right, the parts will be in the positions illustrated in FIG. 4, that is the carrier member 55 will be in its lowermost position along with the coupling member 56 carried thereby. In this position, the toothed annulus 56*d* will be in locking engagement with the mating toothed annulus 21*d*, thus locking coupling member 56 relative to intermediate housing 21. With the sub-housing 58 splined to coupling member 56, it likewise will be in a stationary position. Also, as shown, ratchet teeth 56*c* are disengaged from ratchet teeth 60*c* of main drive gear 60. However, the ratchet teeth 54*b* of pinion gear member 54 are engaged with ratchet teeth 60*b* of main drive gear member 60.

Upon depression of trigger 26, the pinion gear 54 will rotate in the direction indicated by the arrow thereon in FIG. 4, this being a clockwise direction as viewed from the top of the apparatus 20. The ratchet means formed by ratchet teeth 54*b* of pinion gear 54 and ratchet teeth 60*b* of drive gear member 60 in engagement causes concurrent rotation of drive gear member 60 as indicated by the arrow thereon in FIG. 4, with concurrent simultaneous rotation of the orbital gears 34 and 36 in the opposite, or counterclockwise direction resulting. During this movement, the sub-housing 58 remains stationary due to the splined interlocking with the coupling member 56 which is locked in position due to the interaction of toothed annuli 56*d* and 21*d*. As the trigger 26 returns to its original position under force of the spring 28, by reference to FIG. 5, the teeth of the drive gear member 60 have friction applied thereto by means of the inner bent ends of the leaf springs 70 and 72. Simultaneously, the pinion gear member is being urged into engagement with the drive gear member 60 under force of the coil spring 48. However, the ratchet teeth 54*b* and 60 are inclined for positive force in the clockwise direction with the relative forces of leaf springs 70 and 72 being greater than the axial force of the coil spring 48, thereby enabling separation of the ratchet mechanism during this reverse movement of trigger 26, resulting in no rotation of the drive gear member 60 or the orbital gears 34 and 36. On the next depression and release of the trigger 26, the operation is repeated with subsequent actuations creating a twisting of the individual strands 12 and 14 of hair without braiding.

After the desired amount of twist is achieved by the operator, the switch 40 is then moved to the left, as viewed in FIG. 2, and the parts are then in the position depicted in FIG. 3, which would correspond to the switch 40 actuation downwardly as shown in FIG. 6. In this position, the carrier member 55 is displaced upwardly due to the interaction of the projections 55*b* 55*c* and 55*d* with the ramps or cammed edges 21*e*, 21*f* and 21*g* within the intermediate housing portion 21. As shown in FIG. 3, the coupling member 56 will be axially displaced upwardly from the surface of the intermediate housing portion 21, with the toothed annuli 21*d* and 56*d* disengaged to enable selective rotation of coupling member 56 along with the sub-housing 58 in splined relation therewith. Similarly, the ratchet toothed edge 56*c* of coupling member 56 is in engagement with the ratchet toothed annulus 60*c* on the undersurface of drive gear member 60. It is also to be noted that the ratchet means between the pinion gear member 54 and the drive gear member 60 are in engagement due to the meshing of ratchet teeth 54*b* with ratchet teeth 60*b*.

In this mode, as the trigger 26 is depressed inwardly against the force of the spring 28, the pinion gear member 54 is rotated in the direction of the arrow thereon in FIG. 3, which would correspond to a clockwise direction as viewed from above. This force will be transmitted to the drive gear member 60 causing it to turn in the same direction, that is clockwise. With the ratchet means of ratchet teeth 60*c* of drive gear member 60 in engagement with the ratchet edge 56*c* of coupling member 56, this rotational force will be transmitted to the coupling member 60 urging it to turn. Since coupling member 60 is splined to the sub-housing 58, it likewise will be urged to turn or rotate. At this moment, the only resistance will be that provided by the friction of the leaf springs 70 and 72 which have the outer bent ends thereof urging against the inner serrated wall 23*b* of the upper housing member 23, which is fixed as part of the overall housing 22. However, this resistance is overcome and the sub-housing 58 rotates in the direction of the arrow illustrated thereon in FIG. 3, that is clockwise as depicted in FIG. 2. During this rotation, since the subhousing 58 carries the orbital gears 34 and 36, neither of these will rotate, and the positions of the clamping members 16 and 18 will be effectively interchanged through an angle of 180° during this single depression of trigger 26.

As the trigger 26 is released to return to normal under force of the spring 28, friction is applied to the exterior of sub-housing 58 by means of the interaction of the outer bent ends of leaf springs 70 and 72 urging against the interior wall 23*b* of the upper housing portion 23. In addition, the inner bent ends of leaf springs 70 and 72 urging against the teeth of drive gear member 60 tend to apply friction to resist reverse rotation. The combined friction results in separation of the ratchet means between pinion gear member 54 and drive gear member 60, that is the ratchet teeth 54*b* rotate while the ratchet toothed edge 60*b* remains in position.

Upon subsequent actuations of trigger 26, the clamp members 16 and 18 are displaced 180° upon depression and remain stationary during return of the trigger 26. This results in the braid being in a constant clockwise direction as depicted in FIG. 2.

While there are similarities in the braiding apparatus of the instant application as contrasted to the aforementioned application Ser. No. 367,483, the novel construction heretofore described enables simplicity of operation by the use of only one hand of the operator rather than two hands as required by the braiding apparatus of the referenced application. While there has been shown and described a preferred embodiment, it is to be understood that various other adaptations and modifications may be made within the spirit and scope of the invention.

We claim:

1. In a hair twining apparatus, the combination comprising:

a housing including a grippable hollow handle portion having a lower end and an upper end, an intermediate housing portion mounted to said upper end of said handle portion and an upper housing portion mounted to said intermediate housing portion, said upper housing portion having an open top;

a spring-biased trigger having a lower end and an upper end, said upper end being provided with an arcuate rack, said lower end being pivotally mounted to the lower end of said handle with said arcuate rack extending into said handle subjacent said intermediate housing portion;

a pinion gear member rotatably mounted in said intermediate housing portion, said pinion gear member including a pinion gear portion meshing with said arcuate rack for oscillation thereby when said trigger is actuated, said pinion gear member also including a first ratchet means;

a sub-housing within said housing;

a drive gear member rotatably mounted in said sub-housing;

first and second orbital gear members rotatably mounted within said sub-housing in meshing relation with said drive gear member;

first and second clamp means mounted on said sub-housing, each of said hair clamp means being mounted for concurrent rotation with one of said orbital gear members and being configured for gripping a plurality of hair filaments;

coupling means within said housing selectively operable between first and second positions, said coupling means being in splined relation with said sub-housing, said coupling means in said first position locking said sub-housing relative to said housing and in said second position, said coupling means being enabled for selective rotation, said first ratchet means interconnecting said pinion gear member and said drive gear member for rotating said drive gear member and said orbital gear members along with said clamp means in a unidirectional manner with said coupling means in said first position during actuation of said trigger with the locking of said sub-housing to said housing restraining said sub-housing from rotation to thereby twist the hair filaments into strands;

friction means coacting between said housing and said sub-housing; and second ratchet means operable with said coupling means in said second position for enabling unidirectional rotation of said sub-housing concurrently with said drive gear member through said first ratchet means, the rotation incrementally angularly displacing said hair clamp means for twining said strands, said friction means restraining said sub-housing from reverse movement during reverse travel of said trigger under force of its spring.

2. The hair twining apparatus of claim 1 wherein said apparatus further includes a switch member for actuating said coupling means from said first position to said second position.

3. The hair twining apparatus of claim 2 wherein said coupling means includes a coupling member mounted for rotation on a carrier member and said switch member actuates said carrier member.

4. The hair twining apparatus of claim 3 wherein said coupling means further includes ramp means within said housing and said carrier member is configured for coaction therewith to axially displace said carrier member on pivotal movement thereof in response to actuation of said switch member.

5. The hair twining apparatus of claim 4 wherein said first ratchet means includes a toothed portion of said pinion gear member interacting with a toothed portion of said drive gear member.

6. The hair twining apparatus of claim 5 wherein said second ratchet means includes a toothed portion of said coupling member interacting with another toothed portion of said drive gear member.

7. The hair twining apparatus of claim 6 wherein said apparatus further includes friction means coacting between said drive gear member and said sub-housing for assisting in restraining said drive gear member from reverse rotation during reverse travel of said trigger under force of its spring with said coupling means in said first position.

8. The hair twining apparatus of claim 7 wherein each of said friction means includes leaf spring members mounted within said subhousing and having first bent ends coacting with said drive gear member teeth and second bent ends coacting with an inner serrated wall surface of said housing.

9. The hair twining apparatus of claim 8 wherein said switch member is in a position above said handle portion for actuation by the thumb of the operator whereby to enable one hand operation of the apparatus.

* * * * *